United States Patent [19]

Meus

[11] 4,323,229

[45] Apr. 6, 1982

[54] MACHINES FOR ASSEMBLING SHEETS OF LAMINAR MATERIAL SUCH AS PAPER

[75] Inventor: Roger R. Meus, Heusy, Belgium

[73] Assignee: Ordibel Sprl, Dolhain-Limbourg, Belgium

[21] Appl. No.: 100,495

[22] Filed: Dec. 5, 1979

Related U.S. Application Data

[63] Continuation of Ser. No. 890,477, Mar. 27, 1978, abandoned, which is a continuation of Ser. No. 722,375, Sep. 13, 1976, abandoned.

[30] Foreign Application Priority Data

Sep. 15, 1975 [BE] Belgium ..... 833436
Mar. 23, 1979 [BE] Belgium ..... 839934

[51] Int. Cl.[3] ..... B65H 39/04
[52] U.S. Cl. ..... 270/58
[58] Field of Search ..... 270/58

[56] References Cited

U.S. PATENT DOCUMENTS 2,829,888 4/1958 Thomas ..... 270/58
3,108,797 10/1963 Mestre ..... 270/58
3,173,680 3/1965 Dezoppy ..... 270/58
3,216,719 11/1965 Flora ..... 270/58
3,664,656 5/1972 Ryland ..... 270/58

*Primary Examiner*—Edgar S. Burr
*Assistant Examiner*—A. Heinz
*Attorney, Agent, or Firm*—Holman & Stern

[57] ABSTRACT

A machine for assembling sheets of laminar material such as paper in bundles, comprising: a certain number of receptacles arranged parallel or substantially parallel with each other, the receptacles being partially or totally arranged beside each other or above each other, each receptacle intended to receive a certain number of sheets arranged in packets and each having to form part of one of the bundles to be assembled; as many members each intended to drive the upper sheet of one of the packets situated in the receptacle; and a collecting member for the sheets which have partially left their receptacle, owing to the action of the said drive members; the drive members being divided in to at least two groups, all the members of a same group being set in motion simultaneously and subjected to reciprocatory motion by an appropriate control member.

8 Claims, 12 Drawing Figures

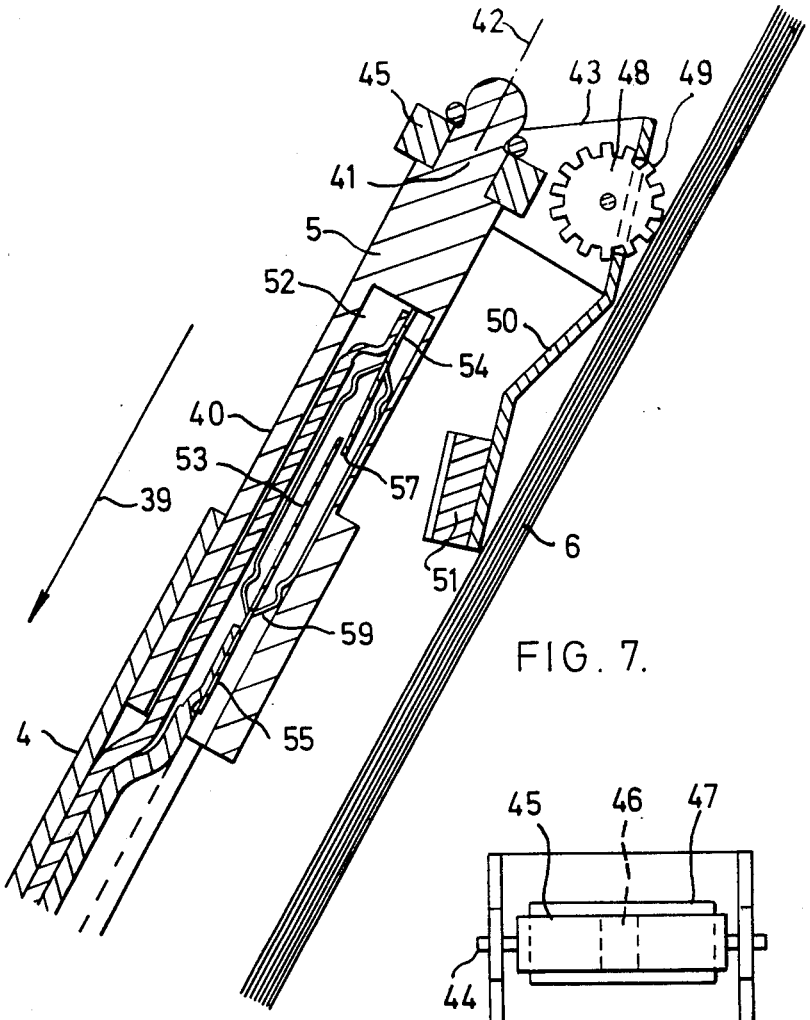
FIG. 7.
FIG. 8.
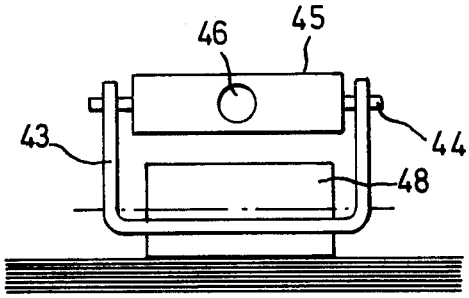
FIG. 9.

MACHINES FOR ASSEMBLING SHEETS OF LAMINAR MATERIAL SUCH AS PAPER

This is a continuation of application Ser. No. 890,477, filed Mar. 27, 1978 which in turn is a continuation of Application Ser. No. 722,375 filed Sept. 13, 1976, both now abandoned.

BACKGROUND OF THE INVENTION

This invention relates to machines for assembling sheets of laminar material such as paper.

Such machines have been known for a long time, and they usually comprise in addition to a chassis intended to support the assembly of all the particular devices constituting the machine itself;

a certain number of receptacles, usually inclined arranged beside each other, the assembly of the receptacles being able to form either a horizontal battery, or an oblique battery, each of the receptacles of the battery being arranged to receive a packet of sheets, usually identical, intended to form a bundle of sheets.

a certain number of members intended to drive the upper sheet of each packet in each of the receptacles, the said drive being synchronous for all the receptacles.

a collecting member, generally formed of one or more parallel belts and driving in a continuous manner the sheets leaving the receptacles, this drive usually occuring with partial or total automatic superposition of the sheets leaving the receptacles, the said sheets being arranged in a train.

a receiving member, receiving each train of sheets at the end of the travel imposed on them by the collecting member. The bundles of sheets thus formed are automatically superposed on each with a small alternate and systamatic shift made in one direction and then the other at the arrival of each new train.

A machine of this type has been developed by the same applicant and described notably in the Belgium Pat. Nos. 577698 and 601747. Similar machines fulfil their function satisfactorily for bundles having a relatively large number of sheets.

It has become necessary to increase the productivity of these machines and also their reliability of operation. These two conditions appear prima facie completely independent, but account must be taken of the fact that in a machine with a high production rate, the periods of time which are allocated to the members ensuring the reliability of operation are reduced, in order to allow them to effectly carry out all the necessary movements. It is thus necessary to modify completely these members, for example by reducing their own inertia, which reduces the time necessary to set them in motion. Besides, an increase in the production means an increase in the displacement speed of all the movable members of the machine, to a speed at which the usual reliability members cannot function effectively. The same problem occurs in a certain manner for the sheets which are to be assembled, which must be able to be moved rapidly at high speed without running the risk of being torn, folded or crumpled.

It follows therefore that the increased requirement of the user can cause by their presence a certain number of problems in a machine which, in normal operation would not happen.

SUMMARY OF THE INVENTION

The present invention has for its object a machine for assembling sheets in bundles, provided with improvements which allow the above mentioned problems to be resolved in an efficient manner and consequently which allow the productivity and the reliability of operation to be increased at the same time. The two aspects of the problem to be resolved by the invention will be described in turn. It must be remembered that the solutions adopted to increase the productivity have an influence on the nature of solutions to be adopted to increase the reliability and vice versa.

A. Productivity

The productivity of machine such as an assembler of the type described in the above mentioned document can be conceived in terms of speed of operation, and in this sense, its increase requires as has already been said above, an increase in the speeds of movement of the members, and a reduction of their own inertia. It seems that under this aspect, a certain limit exists owing to the nature of the sheets to be moved, which when they are thin, are usually folded or crumpled, and cannot accomodate these high speeds without risk of tearing.

The productivity of an assembler can also be conceived in terms of "the coefficient of use" and in this sense, the use does not means exclusively the making of the bundle for which the number of sheets is near or equal to the maximum capacity of the machine in question.

In the light, the problem of increase of the productivity has an aspect completely different from that of the simple increase of the rate of operation of the machine. In other words, one of the problems to which the present invention provides a solution can be put in the following terms.

A machine of the type described above and comprising for example 20 receptacles will be considered. This machine is designed to form bundles containing 20 sheets at the maximum. If it is required to form, by means of this machine, sheets containing for example 7 to 10 sheets, i.e., half at the most of the nominal capacity of the machine, a part of this machine will be unused during the formation of the bundle by means of its other part. In effect, while the 7 to 10 receptacles are really occupied and serve effectively to form bundles, the rest of the machine rests idle without being used at this moment and this constitutes an incontestable disadvantage from the point of view of the productivity of the machine.

In order to find a solution to this disadvantage, different propositions have already been imagined with various results.

It has notably been envisaged to rearrange the capacity of the machines (i.e. the number of their receptacles) in order to be able to form bundles containing a smaller number of sheets, without having to resort to machines of too great capacity. This manner of proceeding has another disadvantage, i.e. the increase in investment and the complication of the task of the operators when a bundle must be formed for which the number of sheets exceeds the capacity of the available machines. In this case recourse must be had to several machines to form a single bundle.

Another device already proposed to remedy this disadvantage consists in arranging the assembly of receptacles of the machine in two distinct groups, each comprising one half of the receptacles of the machine, and each group being set in motion in turn, i.e. alternatively one then the other.

There remains however the disadvantage of only allowing the assembly of bundles of a number of sheets of less than half total number of receptacles of the machine, this being due to the time shift between the movements of the two groups. Besides, the resetting in synchronism of the two groups to be able to make use of the full capacity of the machine could only be done with difficulty, and without guarantee of a truly perfect synchronization.

According to the present invention there is provided a machine for assembling sheets of laminar material such as paper in bundles, comprising: a certain number of receptacles arranged parallel or substantially parallel with each other, the receptacles being partially or totally arranged beside each other or above each other, each receptacle intended to receive a certain number of sheets arranged in packets and each having to form part of one of the bundles to be assembled; as many members each intended to drive the upper sheet of one of the packets situated in the receptacle; and a collecting member for the sheets which have partially left their receptacle, owing to the action of the said drive members; the drive members being divided in to at least two groups, all the members of a same group being set in motion symultaneously and subjected to reciprocatory motion by an appropriate control member.

The different groups can thus be provided with a synchronous motion if need be, in order to allow for the provision of bundles for which the number of sheets can equal that of all the receptacles of the machine or that of the drive members of two or more of the thus formed groups.

According to another advantageous variant of the invention, the above described device comprises in addition a member allowing each group to be shifted relative to the other, so that, when all the sheets of a group, each driven by its own drive means, have left their receptacles under the action of the collecting member of the machine, the sheets of another group are immediately available for their drive by the same collecting member without any shift in time.

In this manner, there is practically no interruption in time between the collection of the different train of sheets, each provided successively by its particular group. Ths speed of the machine can thus be increased and its capacity can be used at its maximum or nearly, whatever be the number of sheets contained in the bundle to be assembled, this number being able, besides, to be modified without disadvantage.

This advantage can be obtained by controlling the different groups or drive members by means of cams of appropriate shape, set in rotation by the motor of the machine by means of suitably arranged clutches.

Owing to this cam device, it is possible to adjust the moment when the sheets of a group must be driven following the sheets of the preceding group. It goes without saying that the cams can be replaced by any other device fulfilling effectively the same role in the same way.

BRIEF DESCRIPTION OF THE DRAWINGS

The invention will now be described in more detail, by way of example only, with reference to the accompanying drawings, in which:

FIG. 7 is a detailed side view in section, similar to FIG. 6, but showing the drive head in its falling position;

FIG. 8 is a plan view of the stirrup.

FIG. 9 is an end view of the stirrup.

In all these figures the same reference numerals represent the same parts.

DETAILED DESCRIPTION OF A PREFERRED EMBODIMENT

Figure 1:
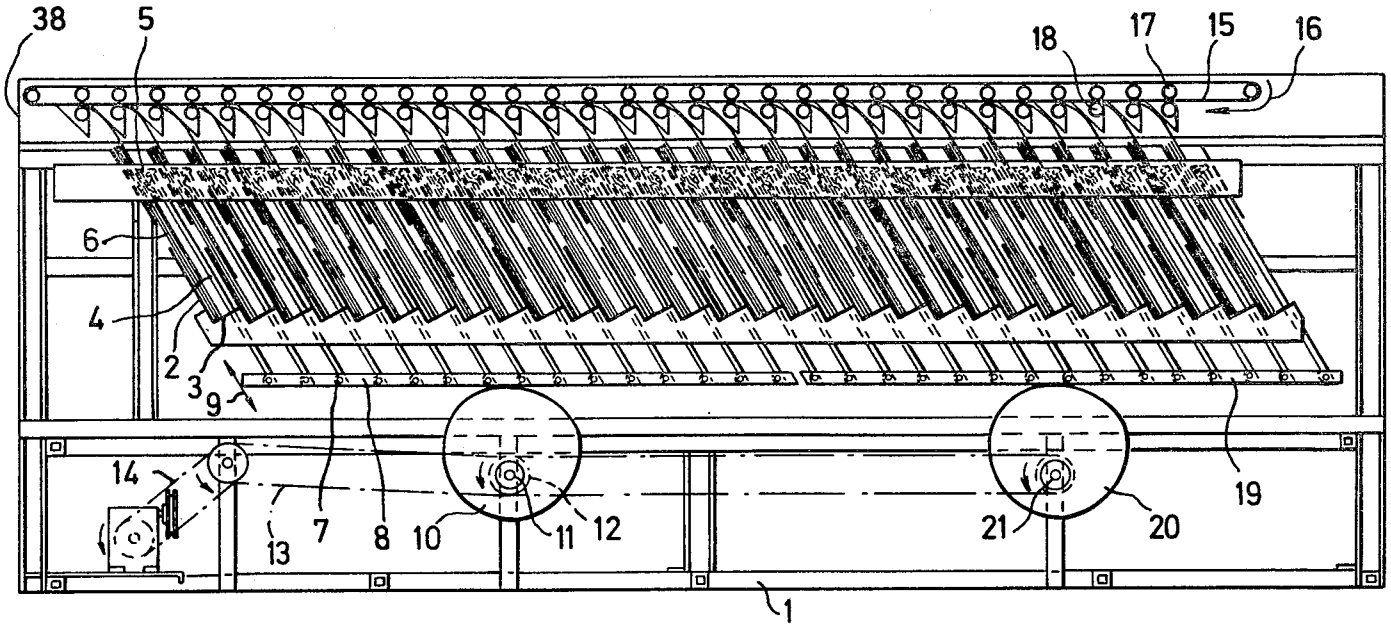
FIG. 1 shows diagrammatically a longitudinal vertical section of a machine provided with a device according to the invention, and allowing the setting in motion synchronously of two groups of drive members of sheets out of their respective receptacle.
Figure 2:
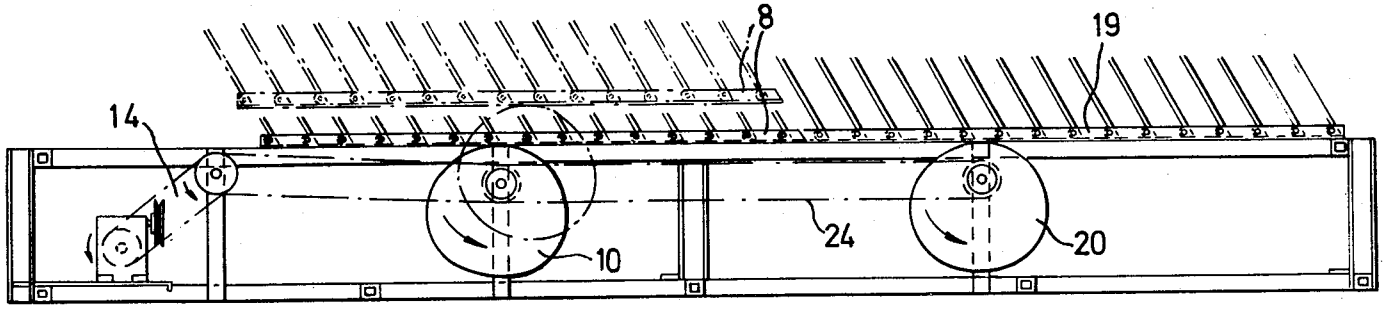
FIG. 2 shows diagrammatically, in longitudinal vertical section a part of the machine provided with a device of the invention, showing how the starting moment of the lifting members of a group can be modified.
Figure 3:
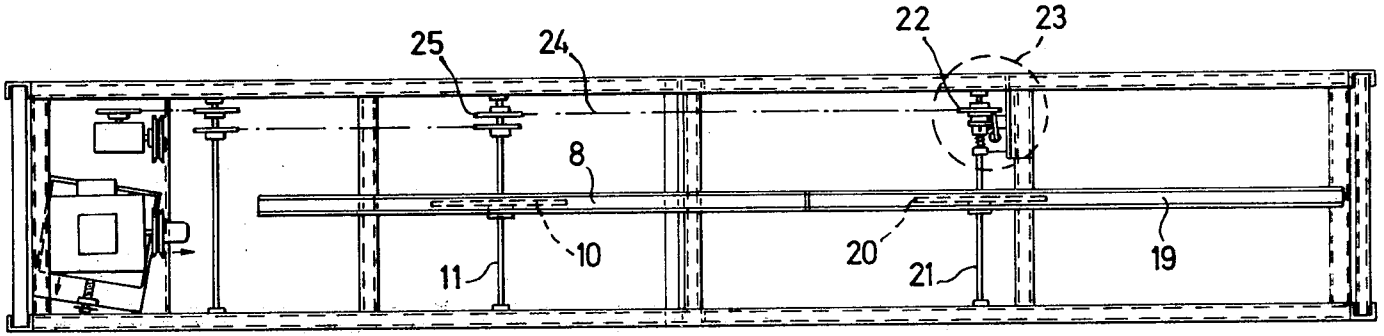
FIG. 3 shows in plan view a part of the machine shown in FIG. 2.

In FIG. 1, the chassis supporting the assembly of the machine is referenced 1, and machine comprises a certain number of receptacles 2, each provided with a base 3 having a notch for allowing a drive member 4 to pass, which on one side rests at 5 on the upper sheet of the packet of sheets 6 located in the receptacle in question, and on the other side rests at 7 on an appropriate articulation on a rod 8. This rod 8 remains horizontal (according to any means known in itself) during the reciprocatory movement (here an up and down movement) following the arrow 9, a movement which is imparted to it by means of a cam 10. The cam 10 rotates about its horizontal axes 11 under the control of the toothed wheel 12, the chain 13 and the motor-reducer 14.

Above the battery of receptacles 2, a set of belts 15 are located which move continuously in the direction of the arrow 16, its lower portion passing between two series of rollers 17 and 18 and driving the upper sheets of the packets of the receptacles when these have partially left their respective receptacle, each under the action of its drive member.

It can immediately be seen that all the sheets to which the drive members are dependent on the same rod 8 leave their receptacle at the same time and are driven in a single train by the belt 15. The machine comprises, in addition, a second rod 19 for which the role is identical to that of the rod 8, but for which the movement is dependent on the cam 20. This cam 20 rotates about its axis 21 itself set in rotation by a pinion 22, through the intermediary of an electro magnetic clutch diagrammatically shown inside the circle 23. The pinion 22 is controlled in turn by the chain 24 and the pinion 25 fixed on the shaft 11.

It can be seen straight-away that the time shift between the reciprocatory movement of the two rods 8 and 19 depends on the relative angular displacement of the two cams 10 and 20 about their respective axis. Owing to the presence of the clutch 23, which in an advantageous embodiment, can be set in its engaged position not only with a well determined angular displacement between the cams 10 and 20, but also with an adjustable angular displacement, either in a continuous manner, or in a discontinuous manner, this shift can be modified at will without any difficulty, which also allows to be regulated, at will and in any manner, the value of the time shift of the movement of the rods 8 and 19 and therefore the corresponding drive members 4 and finally that of the sheets.

Figure 4:
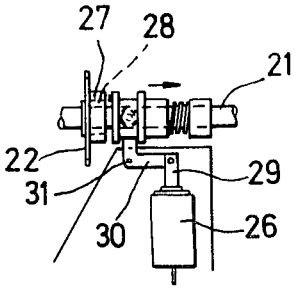
FIGS. 4 and 5 show details of FIG. 3.
Figure 5:
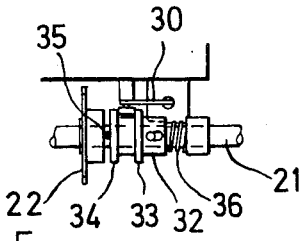

FIGS. 4 and 5 show an embodiment of an electro magnetic clutch allowing at any moment, owing to the control electro magnet 26, the cam 20 to be rotated at the same time as the cam 10.

This clutch operates as follows: the toothed wheel 22 idles about the shaft 21 without being able to slide on it, as does the abutment 27 with which it is integral. This abutment comprises on its side adjacent the electromagnet 26 a certain number of cells 28 judiciously arranged around its periphery. The electro-magnet 26 through its axes 29, its arm 30 (which rotates about a fixed shaft 31), causes an abutment 32 provided with two ears 33 and 34 to be displaced along the shaft 21, the said abutment rotating with the said shaft 21 while being able to slide along this latter. The end of the arm 30 comprises a stud engaged between the two ears 33 and 34. The ear 34 carries on its external face a projection 35 which can engage in one of the cells of the abutment 27 when the electro-magnet is de-excited and when under the influence of the axial spring 36 the ear 34 is maintained against the abutment 27 with the projection in a cell. In this position, the wheel 22 engages the shaft 21 and consequently the cam 20. The adjustment of the shift between the cams 10 and 20 is carried out by choosing in the abutment 27 the appropriate cell, and by exciting the electro-magnet 26, which allows the abutment 32 to be rotated relative to the abutment 27 until the projection 35 is rotated opposite the appropriate cell (these in addition can be provided with an indicator specifying the angular shift which each corresponds). The electro magnetic 26 is then de-excited. If a continuous adjustment is required, use can be made, for example, of a friction clutch which allows the coupling with the abutment 27 at any angular shift.

With the above described device, the user can at will use the two parts of the machine in synchronism or not, with this important advantage that in the case of use of the two parts not in synchronism, the speed of the machine can be substantially increased owing to the reduction in the dead period between the arrival of the trains relative to each of the two parts, a reduction obtained by the adjustment of the cams 10 and 20 to the most favourable position corresponding precisely to the maximum of the reduction of the said dead periods.

B. Dependability and Reliability

The dependability and reliability of a machine of the above described kind is understood in this sense that on the one hand the bundles thus produced contain effectively all the sheets that they should contain and that they do not contain any in double form and that on the other hand the machine warns against such eventualities and that in the case where they are produced in spite of the precautions taken, a warning signal is emitted and the machine automatically stops.

The control of the first of these conditions has been, in a manner known in itself, up to the present time obtained notably by means of an articulated shoe arranged at the leading end of the drive members. Such a shoe has two special positions, i.e. that of the drive of the upper sheet of one of the packets and that called pivoted which the shoe takes up at the end of its drive movement due to the intervention of the driven sheet itself. In this pivoted position, the shoe closes an electric contact which is significant of the effective drive of the upper sheet of the receptacle in question.

This device, although excellent in principle, can in the long term, given the large number of times it is called into use, either have a certain mechanical wear, or have a certain difficulty of an electric nature, pearled deformed or oxidized contacts etc.

In these eventualities, the assembler machine is no longer warned against any risk of a missing sheet. The operation of such a device can equally be perturbed by the presence of paper dust, or by the deposit of ink or any other cause which can prevent a clean contact between the metal parts ensuring the opening and closing of the electrical circuit put into service for this detection operation.

The control of the second of these conditions, i.e. the absence of doubles, is generally obtained by means of a thickness detector in the mechanism, operating equally an electric contact in the case where a double or folded sheet appears.

Such a mechanism is, as will be described later, completed by a control "in situ", and used in electronic connection with the device automating the detection functions, this device also being described later, and forming part of the improvement, the object of the present invention.

According to the invention, this improved device comprises a particular type of drive member for the upper sheet of each of the packets of sheets arranged in the receptacles forming part of the assembler machine. The improvement relative to this particular type of drive member will be defined later in a more precise manner after the description of an embodiment taken from the figures hereinafter mentioned.

Figure 6:
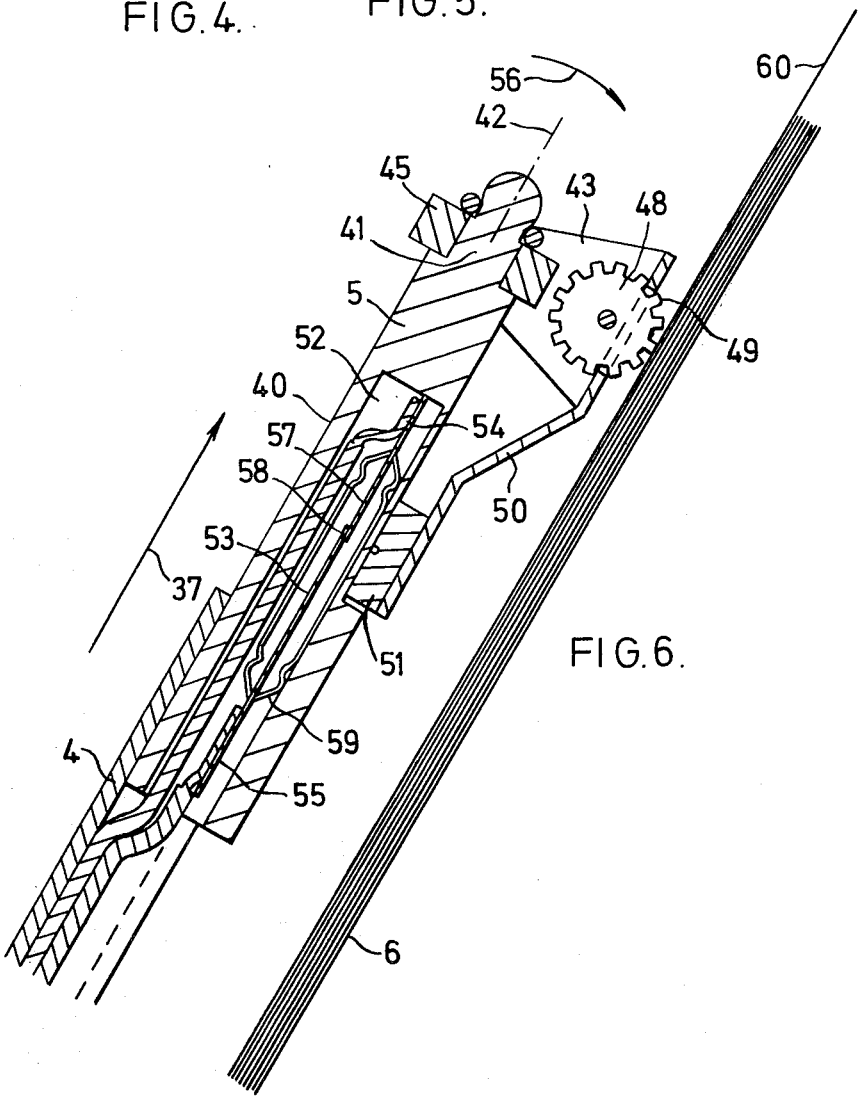
FIG. 6 is a detailed side view in section of an individual drive member showing the drive head in its rising position.

FIGS. 6 and 7 show an enlarged sketch of the leading end of the drive members, in the drive position (FIG. 6) and in the return position (FIG. 7). FIG. 8 shows a diagrammatic plan view of the end stirrup of the member, and FIG. 9 shows an elevation view of this same stirrup, a view according to the arrow 37.

During the drive movement of the upper sheets of the packet through the head 5, the said sheets are clamped by their leading edge between the lower strips of the collecting belt 15 and a series of rollers 18. The drive of the sheets is effected in the direction of the arrow 16, the assembly of sheets forming in a train, a complete bundle being received at 38 at the end of the machine in an appropriate receiving member.

In FIGS. 6 and 7, the packet of sheets arranged in one of the receptacles for which the base is at 2 can be seen in longitudinal section at 6. FIG. 6 shows the head 5 in the rising position (arrow 37) and FIG. 7 shows the head 5 in the falling position (arrow 39).

The head 5, fixed to the end of the metal stem 4, is of a non-magnetic material 40 terminated at 41 by a cylindrical end portion having an axis 42 parallel to that of the stem 4 and serving as a pivot of rotation for a drive runner. This is formed by a stirrup 43 pivoting on the pivot 44 of a balance 45, itself capable of pivoting about the end portion 41 owing to a hole 46 provided to this effect.

The stirrup 43 has a window 47 allowing the passage of a cylindrical drum 48 of uneven material, in one or more sections, and provided at its periphery with axial teeth 49. This drum is fixed relative to the stirrup and moves with it.

The rear part of the stirrup is provided with an arm 59 supporting, fixed to its end, a magnetized pad 51.

The rear of the head 5 has a hollow 52 in which are fixedly recessed, a blade switch 53 its two ends having electric connections 54 and 55 soldered to them. These two connections are connected to the rest of the electric device of the machine, through the stem 4 and the inside of the shape that they are fixed to. These connections serve to signal the missing sheets.

Thus formed, this device operates as follows: during the rising phase (FIG. 6) the head 5 rests on the first sheet of the packet by the rough drum 48. At the beginning of this rising movement, the complete stirrup rotates about its axis (pivot 44) in the direction of the arrow 56 until the magnet 51 contacts the lower face of the hollow 52. At this moment, the magnet 51 presses the small plate 57 against the end of the small plate 58, thus establishing an electric contact. Since these two blade ends 57 and 58 are located inside a watertight bulb 59, either under vacuum or under an atmosphere at low pressure of an inert gas or without action on the contact blades, this suppresses any possibility of wear of the blades by repeated contact.

When the rotation of the stirrup is thus stopped, the drum 48 also stops and, due to the rising movement of the head 5, drive the sheet 60 of the packet upwards. This drive lasts until the moment when the leading part of the sheet 60 is clamped by the collecting belt 15. At this moment, each sheet 60 causes the rotation of the drum 48 in the opposite direction to the arrow 56, the pivoting of the stirrup 43 in the same opposite direction and the separation of the magnetic 51 sufficiently far from the bulb for the two blades 57 and 58 to be separated from each other, thus taking up their normal position in the absence of any bias.

If, in one of the receptacles, a sheet happens not to be driven, at the end of its rising journey, it will not produce rotation of the corresponding stirrup and the electric circuit of the stem remains closed, which allows the operator to notice the fault of operation of the machine and to find the defective or empty receptacle.

The presence of a double sheet can be prevented automatically in the following manner: the two sheets which are supposed to be driven at the same time in a same casing are practically never, in fact, driven at the same moment. There is always a small time shift between the beginnings of the starting movements of the two sheets; i.e. the upper sheet has during its displacement a certain advance relative to the underlying sheet. It follows that the rear portion of this underlying sheet extends beyond the rear portion of the upper sheet. During its descending journey, the stirrup 43 is the pivoted position as shown in FIG. 7. At this moment, the arm 50 comes first into contact with the rear of the upper sheet which continues its rising journey, since it is clamped by the collecting belt. The arm 50 then contacts the rear of the underlying sheet which it jams between itself and the packet of sheets. If at this moment, the upper sheet is still in contact with the drum 48, the friction which it exerts on the latter, integral with the stirrup 43, will force it to rotate about the axis of the spindles 44, which on the one hand tends to disengage the drum 48 from its contact with the free upper sheet, and on the other hand, accentuates the pressure of the arm 15 on the rear of the underlying sheet. This sheet, not only will no longer be able to follow the upper sheet, but will also be constrained to return the base of the receptacle under the drive force of the arm 50 during its descending motion.

It should be noted that the cylindrical form of the drum 48 allows a good contact between the teeth 49 and the upper sheet of the packet to be ensured, from the first sheet of the packet until the last.

It is now possible to define in a clear manner the characteristics of this part of the invention.

The device which forms it and which will be described in an example (FIGS. 6 to 9), is, in the general scope of the assembler machine already mentioned, provided with a stem whose rear end is provided with a linking member, for example an articulation, with the part of the machine which transmits its reciprocatory movement to it, and for which the leading end is provided with a friction bearing articulated on the said end so as to be able to rotate about an axes parallel or substantially parallel to that of the stem, and preferably close to this axes and furthermore about an axes substantially perpendicular to the first mentioned axes.

This device is essentially characterized in that the said slider comprises on the one hand a friction member of rough material, integral with the said slider and extending beyond the said slider on the side remote from the stem, so that in the contact position of the stem on the sheets, contact is established by the said friction member, in that the said slider comprises, in addition, an integral arm provided with a magnet preferably a permanent magnet, and in that the stem also comprises an electric switch provided with two metal blades intended to make contact with each other, the said blades being arranged inside an electrically non-conducting bulb, the said bulb being fixed to the stem so that the said blades are or not in contact with each other according to the position of the magnet integral with the bearing and turning with it.

According to an advantageous variant of this device, the bulb containing the two contacts is either sealed at preferably low pressure, with an inert gas vis-a-vis the metal contacts, or is sealed under vacuum. This variant allows an exceptionally high number of operations to be ensured without any fear of defective operation and without fear of wear of the contacts or whatever reason, where, paper dust, presence of parasitic particles of ink etc.

According to another advantageous variant of this device, the friction member integral with the slider is formed of a cylinder for which the axes is substantially perpendicular to that of the stem and for which the periphery is provided with slots, arranged preferably along the axes of the cylinder, or any other manner ensuring the drive of the sheets strictly in the longitudinal direction of the receptacles.

Also, according to a specially interesting embodiment of the invention, the arm integral with the slider as well as the friction member are situated on either side of the plane which passing through the axis of rotation of the friction bearing perpendicular to the stem 4, is perpendicular to the plane of the sheets of the packet, at least during the downwards phase of the stem. In this way, during this phase, on the one hand the rear part of the arm tends to block, then drive downwards a double sheet which may be present and on the other hand the rough drum tends to disengage the upper sheet, these two movements occurring, under the effect of the upper sheet, the moment when it is clamped by the collecting belt.

It is useful to indicate that the presence of the axis of rotation 42 allows, when certain receptacles must remain out of use, the corresponding slides to be returned, so that the magnet 51 can no longer cause the contact between the blades 57 and 58. No untimely signal can therefore emanate from a receptacle which is not in use.

The present invention has further for its object a device allowing the embodiments already described to be made with a very high degree of efficiency and reliability.

Such a device is described hereafter in a non-limiting example. Thanks to this device, the assembler machine is warned in a quasi-perfect manner against the possibility of forming a bundle with a missing sheet, without being ipso facto warned of it and without the machine stopping. Such a device is shown diagrammatically by the block diagram of FIG. 10. This refers to an assembler comprising two groups or distinct ramps of receptacles, and therefore two distinct series of stems. It applies "mutatis mutan dis" to an assembler comprising either a single ramp or group of receptacles, or more than two.

Figure 10:
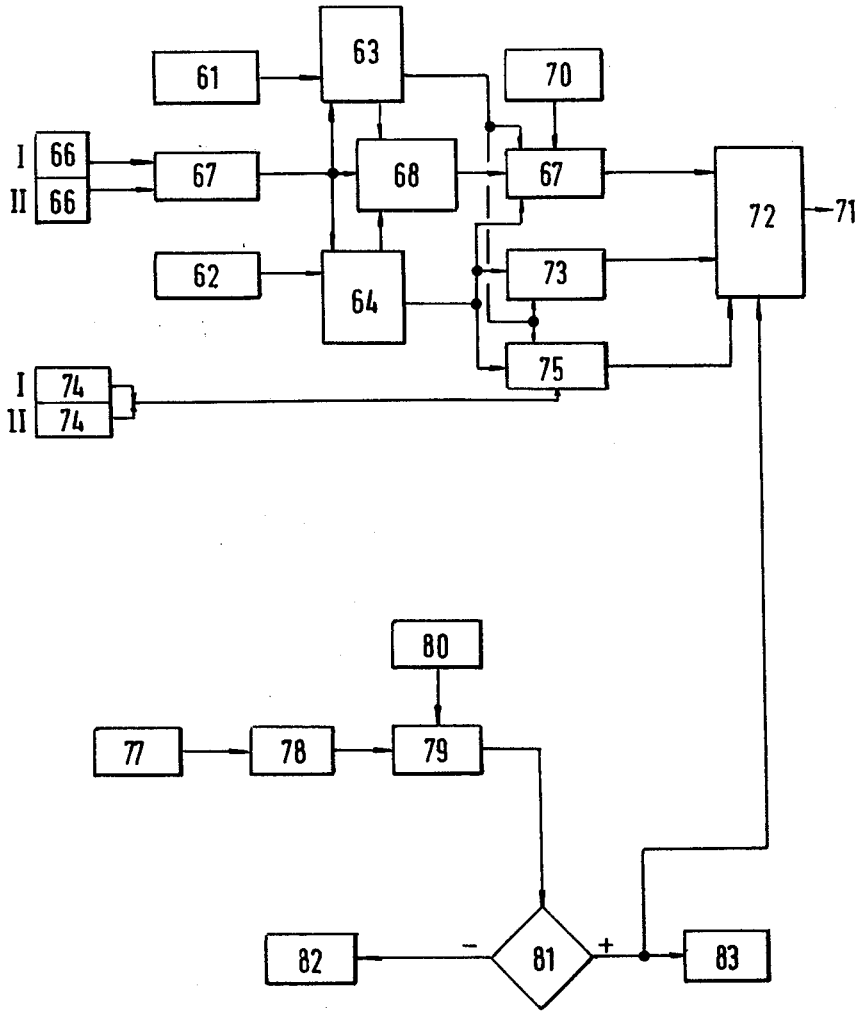
FIG. 10 is a block diagram of the present invention.

Considering FIG. 10, the block 61 represents the "x" slides of the ramp I, the block 62 represents the "x" slides of the ramp II. All the slides control, as described above, a switch 53 for which the position is significant of a determined state of one of the sheets or of the slider of the receptacle in question. All the states of the switches are stored in the two blocks 63 and 64 respectively for the ramps I and II.

At the beginning of the cycle, all the stems are at their low position in their respective receptacles. At this moment all the switches 53 are in the open position (that is to say that current does not pass, or the contact between the blade 57 and 58 of the switches is not established,); because each slider 5 at the end of the sending movement is located in the position shown in FIG. 7.

During the synchronous rise of all the stems of a given ramp, all the corresponding slides are in the position shown in FIG. 6, i.e. all the switches 53 are in the closed position (terminals 57 and 58 in contact with each other, or passing a current) and said slides are in the position of FIG. 6 in which they each drive the upper sheet of the packet of sheets located in their respective receptacle.

The length of upwards travel is adjusted to a minimum value so that the first sheets driven by the slides are gripped by their leading edge between the belt 15 and the runners 18 of the collecting device (see FIG. 1).

It is important nevertheless that the sheets which accidently have a first delay in starting or being driven, or are slightly folded, can (in the scope of certain limits), be waited for to allow them to form part of the "train" intended to form the bundle in question.

This condition is performed according to the invention, by giving an extra travel to the stem. This extra travel is completed by holding for a short period (carefully limited), all the stems in the position that they occupy at the end of the extra travel. This delay is made use of to check if there is no receptacle out of which, for whatever reason, no sheet has been driven.

Figure 11:
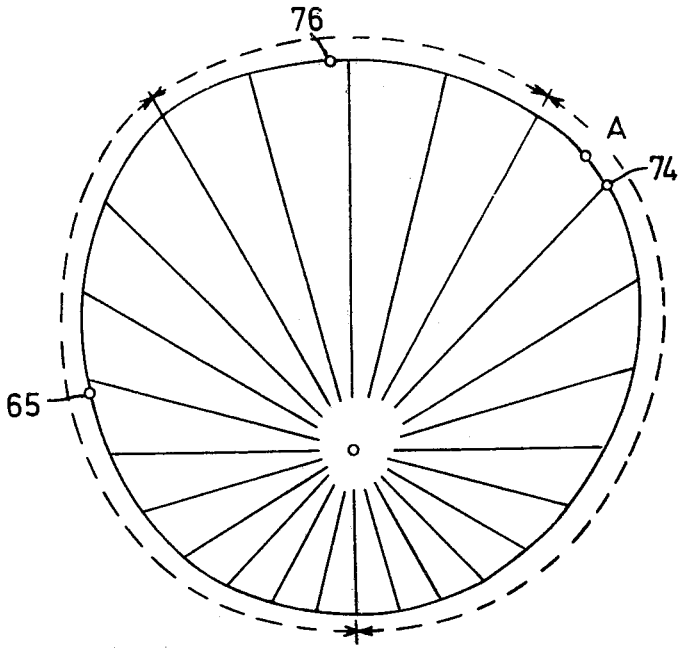
FIG. 11 is an enlarged view of the cam of FIG. 1.
Figure 12:
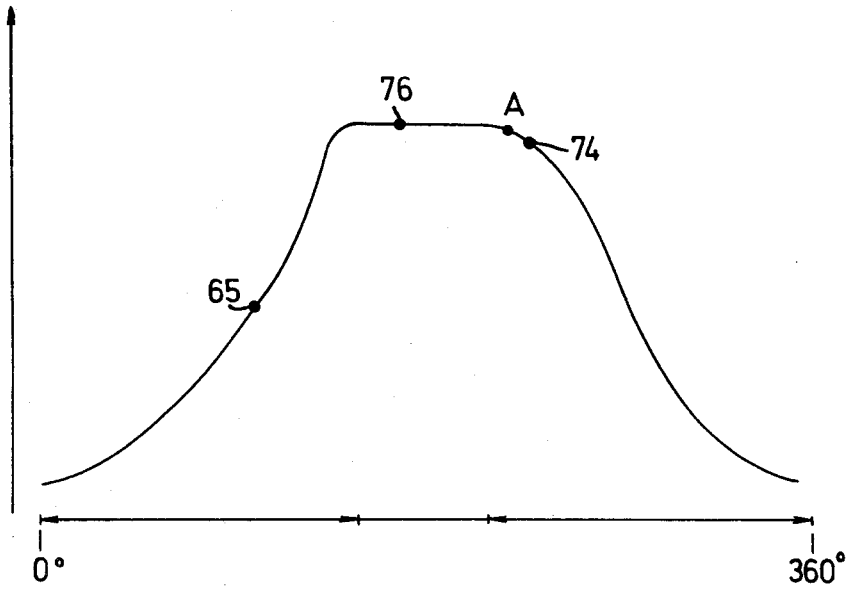
FIG. 12 is a diagram of displacement versus angle of rotation for the cam of FIG. 1.

One arrives there in a particularly easy and reliable manner as follows. The following explanation makes use of, in addition to FIG. 10, FIGS. 11 and 12 which show respectively the form of a cam (such as 10 or 20 taken from FIG. 1 and the rectangular development of the radii of this cam.

Approximately half-way (point 65) along the upwards travel of the stems, a contact fixed on the cam 10 closes a switch 66 authorising the detection on the state of the stems.

By "detection" it is meant here, the checking that all the sliders have operated, i.e. have passed the position of FIG. 6 and that of FIG. 7. The authorization signal (block 67) is based on the ascertion that at the point 65 (FIG. 11) all the sliders are in the position of FIG. 6. This condition fulfilled, the block 67 sends to the blocks 63 and 64 (memory's of the state of the sliders of the different receptacles of the groups I and II), as well as the block 68 treating an "AND" function as explained later, the authorization signal to operate. The two blocks 63 and 64 are each provided with two circuits for generating "OR" and "AND" functions.

From the moment when the first sheet of one of the receptacles of the ramp I is driven by the collecting device and causes the pivoting of its slider from the position of FIG. 6 to that of FIG. 7, the block 63 sends the signal corresponding to the function "OR" to the block 69, called a "missing" detection circuit, and puts the circuit in operation for a period adjusted by the time device 70, at the end of which, if the block 63 has not emitted the signal corresponding to the function "AND", to which the pivoting of all the sliders of the group in question from the position of FIG. 6 to that of FIG. 7 corresponds, the said block 69 causes the stopping of the ramp (or group) control motor 71, by means of the circuit 72 appropriate to this effect.

In fact, if the signal of the function "AND" appears, it cancels the stopping order for the motor 71, while if the function "AND" does not emit its signal in the time required by the block 70, the block 69 controls effectively the stopping of the motor 71. In the case where there exists two ramps, operating one after the other, the circuit 67, recognising the position of the ramps, connects itself to the ramp which is going to commence the rising phase of this movement.

The device of the invention must on the one hand be warned against the presence from the start of a slider in the wrong position or possibly detached and on the other hand warn the operator that all the receptacles are empty. From this point of view, the fact that a receptacle is empty, is translated by the machine, as being a missing sheet.

The control from the start of all the slides positioned correctly is obtained as follows: if at the moment when the switch 66 is engaged by cam 10 which rotates about its axes, all the stem switches are in the correct position, the block 63 sends the signal opposed to "OR" or in other words, the signal "NOT OR" to the block 73 preparing the stopping of the motor 71. In this case, the signal sent by 66 (which is only emitted during a very short period) superimposed on the "NOT OR" signal cancels the stopping order sent by 73. On the contrary, if one of the slides is detached or open, the block 63 emits the "OR" signal immediately, which added to the signal 66 confirms by 73 the stopping order of the motor 71 of the ramp in question. In other words, the signal 66 emitted for a very short period gives rise either to a warning signal, combined with the output of the "NOT OR" signal or to a stored signal for the immediate output of an "OR" signal.

At the end of the removal of the sheets, all the receptacles are empty, and no "OR" signal can appear in due course since there are no sheets present to pivot the slides. The block 63 will thus emit the "NOT OR" signal. This signal combined with that emitted by a warning device 74 drives a switch fixed on the cam 10 at the beginning of the period when it starts to descend the ramp, causes the activation of the block 75 controlling the stopping of the motor 71 through the block 72.

The signal 74 emitted by the cam cannot be sent in the case where the detection has worked and given a positive response i.e. "all the sliders are in the position of FIG. 7", which it makes at the moment 76 of the horizontal region of the shape developed by the cam 10. This horizontal region, during which no stem can either rise nor fall is made sufficiently long to be sure that one or other delayed sheet has had the time to be clamped by the collecting device and to send its corresponding "OR" signal.

In the contrary case, there would be a risk of lowering the stem without having had the time to detect the absence in question.

The absence of sheets in the receptacles is only detected at the end of the horizontal zone which is made sufficiently long to be quite certain that the "absence" detection has not taken place, i.e. a short moment after the moment set by the time adjusting block 70.

The device of the application also allows the presence of a double sheet to be detected, coming from one of the receptacles. To this end the device of the present application has, at the end of the travel of the train of sheets on the point of forming a bundle, a photo-electric cell 77 for which the direction of working is perpendicular to that of the displacement of the sheets. This cell registers the passage of a train and sends a corresponding signal to an appropriate memory 78 which transmits it to a delay circuit for the stacking of the sheets, a stacking for which the period is adjusted by the time circuit 80. Once the stacking time has passed, a signal is sent to the test apparatus 81 which can be a feeler detecting the thickness of the bundles with an accuracy such that a double is revealed. The response "no double" is translated by a signal sent to 82 (stapling authorization) while the response "there is a double" is translated by a signal sent on the one hand to 72 to stop the motor 71 and on the other hand to 83 which stops the motor 84 controlling the drive belts of the sheets.

The starting of the stapler resets the circuit 63 (or 64) to zero because this latter was in the position 1 corresponding to the "AND" function.

If by chance, a bundle contains at the same time a double and an absence, the total number of sheets is correct for the bundle in question, but the stapler cannot function, because the block 63 or 64 has not been able to send the "AND" signal on account of the absent sheet; the reliability is thus well assured.

It is to be pointed out that the device of the application is warned against a parasitic erroneous detection of an absence, due for example to an accidental vibration of a slider on or against a stem. Such a vibration could not cause an untimely opening of one of the switches 53 of the stem transferred from the closed position to the open position, which could have for effect, in the case of a "real" absence, that it may not be able to detect it. The reason for this is that the vibrations of the slider only cause a separation of a pad 51 shorter than the distance to which it authorises the opening of the switch 53. This remains closed and can signal a real "absence" even if the slider vibrates.

I claim:

1. In a machine for assembling sheets into bundles, said machine comprising:

a plurality of adjacent receptacles, for receiving a plurality of packets of sheets, arranged substantially parallel with each other, each of said packets contributing one of its sheets for each bundle to be assembled;

a plurality of reciprocating drive members for reciprocating in first and second reciprocating directions, each drive member being associated with one of said receptacles, each of said drive members for partially driving an upper sheet out of each of said packets received in said receptacles when moving in said first and second directions;

a single drive means for operating said plurality of reciprocating drive members;

a collecting member for simultaneously collecting said upper sheets when they have been partially driven out of said receptacles, said collecting member collecting said sheets as a train;

a receiving member for receiving said train of sheets and stacking said train as a bundle of assembled sheets, said machine being characterized by:

means dividing said plurality of drive members into at least two groups, said means including control means for selectively engaging said drive members in first, second and third alternative operating modes, in said first mode said control means engaging all groups of driving members with said drive means for simultaneous operating, in said second mode said control means engaging all groups of said drive members with said drive means for non-simultaneous operation, in said third mode said control means engaging less than all groups of said drive members with said drive means for operation, said non-simultaneous operation resulting in the provision of sub-trains of sheets for collection by said collecting member;

wherein each drive member has a longitudinal axis and a leading end, said leading end provided with a slider which is articulated on said leading end for rotation about a first axis substantially parallel to said longitudinal axis of said drive member and for rotation about a second axis substantially perpendicular to said longitudinal axis, said rotation about said second axis being between a contact position in which a part of said slider contacts said upper sheet when said drive member moves in said first direction and a non-driving position when said drive member moves in said second direction; and wherein said part of said slider includes a friction member of rough material extending beyond said slider on a side remote from said drive member, and an electric nonconducting bulb fixed to said drive member, said bulb containing an electric switch comprising two metal blades, said slider further comprising an arm provided with a magnet, said arm rotating with said slider about said second axis, said magnet closing said switch by causing said blades to contact when said drive member is in said contact position and, alternatively, said switch being open and said blades not in contact when said drive member is in said non-driving position.

2. The machine of claim 1 wherein said bulb is sealed under low pressure with an inert gas, inert with respect to said metal blades.

3. The machine of claim 1 wherein said bulb is sealed under vacuum.

4. The machine of claim 1 wherein said friction member comprises a substantially cylindrical form having a longitudinal axis, said form being mounted for rotation about said longitudinal axis of said form, and includes grooves around said form parallel to said longitudinal axis.

5. The machine of claim 4 wherein when said drive member is in said non-driving position, said arm is disposed on one side of a plane, said plane being perpendicular to said sheets of said packet and passing through said longitudinal axis of said friction member, and said friction member is on the other side of said plane.

6. The machine of claim 1 further comprising electrical means for detecting an absence of a partially driven sheet, said electrical means including said electrical switch comprising said two metal blades and further including means for stopping said single drive means when said absence is detected.

7. The machine of claim 6 wherein said electrical means detects said absence during a predetermined phase of said movement of said drive means, said drive means providing phase signals to said electrical means.

8. The machine of claim 6 wherein said electrical means includes means for detecting a double sheet in said subtrain, and means, responsive to said means for detecting, for stopping said collecting member when said double sheet is detected.

* * * * *